United States Patent [19]

Wolfe, Jr.

[11] Patent Number: 4,700,163

[45] Date of Patent: Oct. 13, 1987

[54] REMOVABLE MAGNETIC SWITCH SECURITY SYSTEM FOR BUILDINGS

[75] Inventor: Alger W. Wolfe, Jr., Austin, Tex.

[73] Assignee: Security Technologies, Houston, Tex.

[21] Appl. No.: 912,634

[22] Filed: Sep. 29, 1986

[51] Int. Cl.[4] ..... H01H 9/00

[52] U.S. Cl. ..... 335/205; 335/206; 200/61.7; 200/61.82

[58] Field of Search ..... 335/205, 206, 207; 200/61.7, 61.62, 61.81, 61.82

[56] References Cited

U.S. PATENT DOCUMENTS

| | | | |
|---|---|---|---|
| 3,211,872 | 10/1965 | Baer | 200/61.82 X |
| 3,896,404 | 7/1975 | Peterson | 200/61.7 X |
| 4,211,990 | 7/1980 | Gwozdz | 335/205 |

*Primary Examiner*—George Harris

*Attorney, Agent, or Firm*—Vinson & Elkins

[57] ABSTRACT

A security system for a home to actuate a signal upon the opening of a movable closure member (12) mounted within a fixed framing member (14). The security system includes a switch assembly (20) having a cylindrical housing (24), a magnetic switch element (26) removably received within the housing (24), and an outer removable cap (28) fitting over the open end of the housing (24) to permit selective insertion and removal of the switch element (26). When the housing (24) is positioned within a bore (21) of the fixed framing member (14), the cap is the only exposed visible portion of the switch assembly (20) and may be provided in a variety of preselected colors in accordance with the color of the framing member (14) while the remainder of the switch assembly (20) may be of a single base color.

12 Claims, 8 Drawing Figures

REMOVABLE MAGNETIC SWITCH SECURITY SYSTEM FOR BUILDINGS

This invention relates to a security system for a building or the like and more particularly to a magnetic switch assembly for such a security system for actuating a signal or alarm in the system upon the opening of a closure, such as a window or door of a building to be protected.

Heretofore, security systems have been provided for buildings or the like, such as a home, utilizing a magnetic switch assembly, such as a reed switch, in a series loop electrical circuit. For example, U.S. Pat. No. 4,148,001 dated Apr. 3, 1979 is directed to a magnetically operated electric switch positioned in an opening in a door jamb including a reed switch fitting within a cylindrical plastic housing, and a coacting magnet positioned in an opening in an associated door. The reed switch is actuated when the magnet in the door is brought close to the outer end of the reed switch as in the closed position of the door. When the door is opened, the switch moves to a position to actuate a signal.

U.S. Pat. No. 3,636,485 likewise shows a security alarm system utilizing a reed switch in which the reed switch may be easily disarmed by rotation of an outer disc.

U.S. Pat. No. 4,371,856 dated Feb. 1, 1983 has a switch assembly including a reed switch housed within a cylindrical housing and electric leads extending to the reed switch from openings in the housing. An end plate closing an outer end of the housing fits within and is surrounded by the housing.

Other references showing somewhat similar types of switch assemblies for security systems include U.S. Pat. No. 4,005,295 dated Jan. 25, 1977; U.S. Pat. No. 4,455,462, dated June 19, 1984; and U.S. Pat. No. 4,554,618 dated Nov. 19, 1985.

A magnetic switch in such a security system is normally positioned within a cylindrical housing which is placed within a generally cylindrical opening bored in a fixed wooden framing member adjacent an associated closure member, such as a window or door. The switch housing including its exposed outer end is normally painted the same color as the associated framing member and may be painted in a variety of predetermined colors, depending on the selected color of the framing member. The security system is usually installed by the boring of suitable openings in the framing members after the framing members have been painted. Thus, it is desirable that at least the visible exposed end of the switch housing which may be flush with the framing member be of the same color as the framing member.

SUMMARY OF THE INVENTION

The present invention is directed to a security system for a building, such as a house, which includes a switch assembly adapted to be inserted within a cylindrical opening of a wooden framing member for a movable closure, such as a window or door. The switch assembly has an outer cylindrical housing which receives a switch element therein removably connected to a pair of leads extending from the inner end of the housing. The electrical leads of the switch element and the electrical leads of the housing are removably attached by a suitable prong and socket combination with guide means to align the switch element accurately with respect to the receiving housing.

The outer end of the housing has a removable cap or cover thereon completely covering the outer end of the housing and the switch element with the outer surface of the removable cap being flush with the adjacent wooden framing member. The end cap may be selected of a color similar to the color of the associated wooden framing member and since the cylindrical housing is not exposed to view, it may be of a different base color. Thus, the switch assembly may be of a standard base color regardless of the color of the associated framing member while a variety of caps having various colors may be employed with a color corresponding to the color of the associated wooden framing member. The end caps may be easily removed from the outer cylindrical housing to permit replacement of the switch element. As a result of such an arrangement, the standard switch assembly housing may be provided with a plurality of end caps having various selected colors thereby minimizing the stocking of switch assemblies or contact switches having more than one color as has been common heretofore.

It is an object of the present invention to provide a switch assembly for use with a home security system in a series loop electrical circuit for insertion within a cylindrical opening of a wooden framing member with the switch assembly having a generally cylindrical housing removably receiving a switch element and an outer removable cap or cover completely covering the outer end of the housing and adapted to be positioned within the cylindrical opening with its outer surface flush with the outer surface of the adjacent wooden framing member.

An additional object is to provide such a switch assembly in which electrical leads extending from the cylindrical housing are electrically connected to electrical leads of the switch element by a suitable socket and prong combination thereby to permit easy replacement of the switch element.

It is a further object of the invention to provide such a switch assembly having an outer end cap which may be selected from a variety of colors to correspond to the color of the adjacent associated wooden framing member.

A further object of the invention is to provide a method for the installation of such a switch assembly and associated security system in a wooden framing member and an associated closure member, such as a door or window.

Other objects, features and advantages of this invention will become more apparent after referring to the following specification and drawings.

Figure 2:
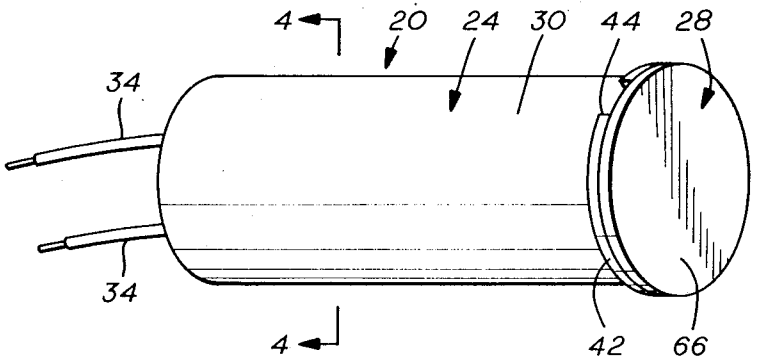
FIG. 2 is a perspective view of the magnetic switch assembly removed from the doorjamb.
Figure 1:
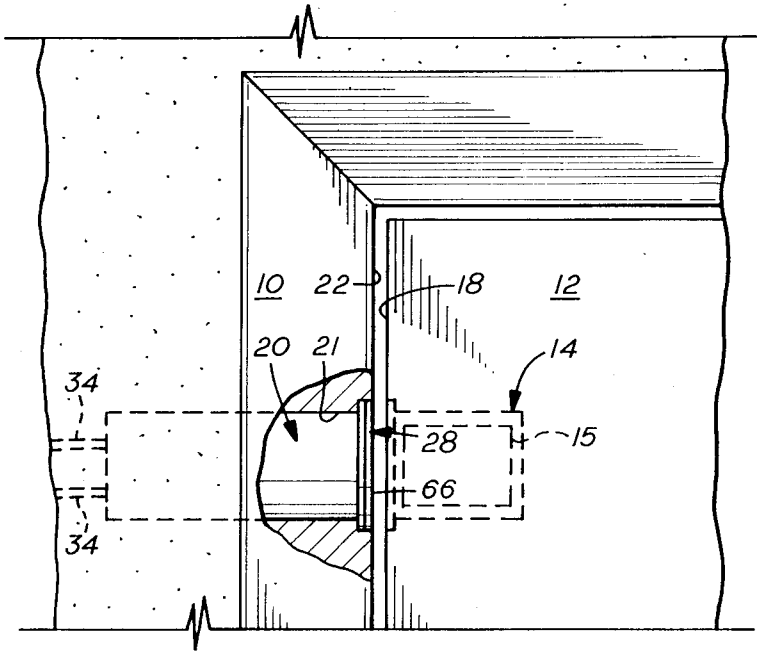
FIG. 1 is a schematic showing the magnetic switch assembly comprising the present invention installed in a doorjamb adjacent a door having an axially aligned magnet therein and providing a signal or alarm upon opening of the door.

Referring now to the drawings for a better understanding of this invention, and more particularly to FIG. 1, a doorjamb 10 is shown which forms a fixed framing member for a closure such as door 12. A cylindrical opening is bored in door 12 and a generally cylindrical plastic housing 14 having a magnet 15 therein is inserted within the cylindrical opening. Housing 14 has an enlarged diameter end cap which may be recessed within a counterbore of the opening in the door so that the outer surface of housing 14 forms a continuation of the adjacent edge surface 18 of door 12 and is flush therewith.

A magnetic switch assembly generally indicated at 20 and forming an important part of the present invention is shown positioned within a cylindrical opening 21 bored in doorjamb 10. Opening 21 has a counterbore so that the outer surface of magnetic switch assembly 20 forms a smooth continuation of the adjacent surface 22 of doorjamb 10 and is flush therewith.

Figure 3:
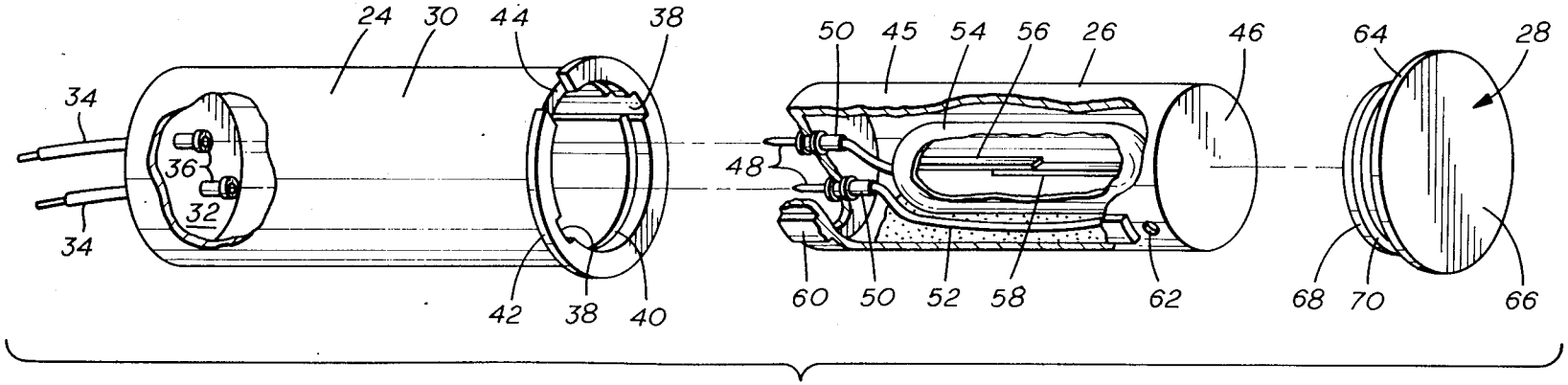
FIG. 3 is an exploded view of the magnetic switch assembly shown in FIG. 2 illustrating the outer housing, the magnetic switch element, and the outer cap.
Figure 6:
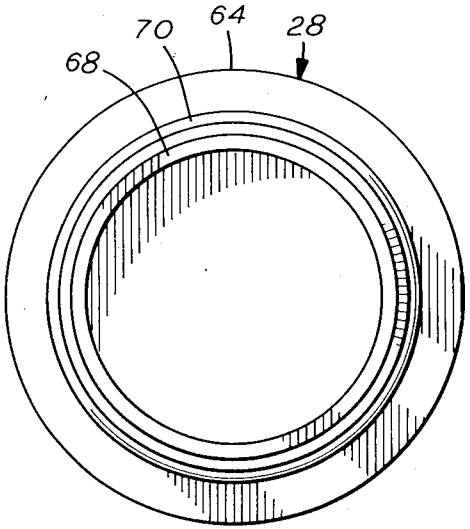
FIG. 6 is a rear plan of the cap.
Figure 5:
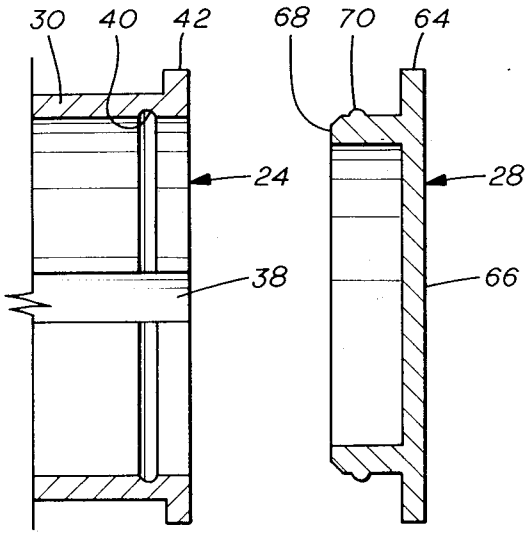
FIG. 5 is an enlarged fragmentary longitudinal sectional view of the outer housing and cap with the cap shown removed from the outer housing.
Figure 4:
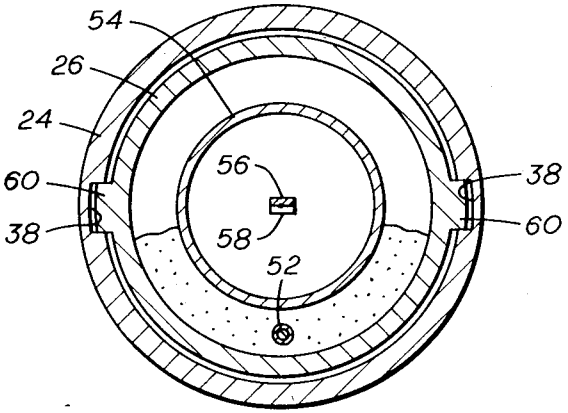
FIG. 4 is a section of the magnetic switch assembly taken generally along line 4—4 of FIG. 2.

Magnetic switch assembly 20 includes three (3) interfitting components or elements as shown particularly in FIG. 3, comprising an outer generally cylindrical shell or housing generally indicated at 24, a magnetic switch element generally indicated at 26 and received within housing 24, and an outer cap generally indicated at 28 and fitting within an open end of housing 24. Housing 24 as shown in FIGS. 3–5 includes a cylindrical body 30 formed of a suitable plastic material and having a closed end 32 and an opposed open end. Electrical leads 34 are connected to receiving sockets 36 mounted within suitable openings in closed end 32. A pair of opposed internal longitudinal grooves 38 extend the length of body 30. An annular internal groove 40 is provided in body 30 adjacent the open end thereof, and a flange 42 extends about the open end. Flange 42 has a slot 44 therein adapted to receive a tool for removal of cap 28.

Switch element 26 includes a cylindrical plastic body 45 having opposed closed ends 46. A pair of prongs 48 are secured to one of the ends 46 and have receiving sockets 50 inside body 45 to receive electrical leads 52 which are secured thereto in electrical contact relation. Leads 52 extend to a reed switch indicated generally at 54 and having a pair of coacting contacts 56 and 58 therein. A suitable epoxy or silicone material fills the void between reed switch 54 and the inner periphery of plastic body 45 to provide a waterproof insulation seal and secure prongs 48 along with sockets 50 to body 45. The outer surface of plastic body 45 has a pair of opposed longitudinally extending splines or ribs 60 adapted to fit within internal grooves 38 of outer housing 24 so that prongs 48 are accurately received within receiving sockets 36. A pair of opposed indentations 62 are provided on opposed sides of body 45 to receive a suitable tool for removal of switch element 26 from housing 24 as might be desirable for replacement or the like.

Outer cap 28 formed of a suitable plastic material such as polyvinylchloride (PVC) includes an outer disc-shaped solid base portion 64 having an outer surface 66 which is adapted to be flush and form a smooth continuation of the adjacent doorjamb surface 22 in which the magnetic switch assembly 20 is positioned. Base portion 64 defines a flange which is in contacting relation with flange 42 of outer housing 24 when in assembled relation. An inner cylindrical sleeve or rim portion 68 extends from base 64 and has an annular rib or projection 70 about its outer surface which is adapted to fit within and to mate with annular groove 40 in outer housing 24 in assembled relation. It is pointed out that cap 28 may be provided in a variety of preselected colors in accordance with the basic colors utilized for the framing members about the closure member or door 12. Since cap 28 is the only visible portion of switch assembly 20 that is exposed to view upon insertion of switch assembly 20, it is only necessary that cap 28 be of the same color as the adjacent closure or framing member, and outer housing 24 as well as switch element 26 may of any color since not exposed to view.

Figure 8:
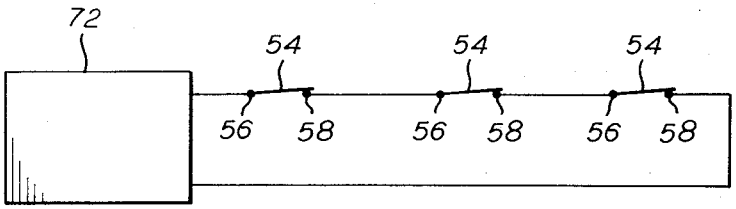
FIG. 8 is a schematic of the electrical loop circuit showing the magnetic switches in normally closed condition.
Figure 7:
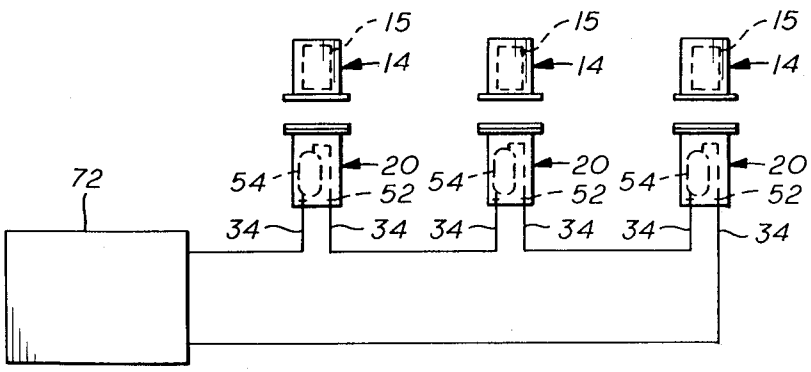
FIG. 7 is a schematic of the wiring diagram showing a plurality of magnetic switches assemblies comprising the present invention arranged in a series electrical loop circuit adjacent associated magnets.

Referring to FIGS. 7 and 8, a closed loop electrical diagram or circuit is shown having a plurality of magnetic switch assemblies 20 therein. Associated magnets 15 mounted within closure members are shown in FIG. 7 as axially aligned with switch assemblies 20 in the closed position of the closure members. It is not necessary upon the initial construction of a building, such as a home, that the switch elements 26 be installed within outer housings 24 or that the security system be installed. When the home is initially built, suitable wiring and suitable bored openings are provided in the closure members and the adjacent framing members with caps 28 and associated outer housings 24 being inserted without switch elements 26. Then, if at a later time it is desired to install the security system, all that is necessary is that caps 28 be removed, switch elements 26 inserted within housings 24,. and caps 28 of suitable color be reinserted on housings 24. the security system is then operable.

It is noted that switch element 26 which is shown as a reed switch is well known in the art and that contacts 56, 58 housed in plastic body 45 are connected to electrical leads 52 and 34, which, in turn, are connected to a suitable signal light or other alarm shown diagrammatically at 72. While switch contacts 56 and 58 are illustrated as being normally closed, it is possible that electrical circuitry could be provided in which the contacts are normally open. In a reed switch, a magnetic line of force of sufficient density is provided when magnets 15 are axially aligned with magnetic switch assemblies 20 to have contacts 56 and 58 attract each other and thereby touch to assume an electrically closed condition. In the absence of the magnetic field of sufficient density such as occurs during opening of the closure member, magnets 15 move out of axial alignment with magnetic switch assemblies 20 and then contacts 56 and 58 are spring biased apart from each other to provide an open condition. This causes a signal or alarm at panel 72.

Thus, during the initial construction of a home, openings are bored in the fixed framing members adjacent closure members and suitable wiring including leads 34 are installed together with outer housings 24 and caps 28 if a decision has not been made to purchase the security system, or the home being built has not yet been sold. Then if a subsequent decision is made to have a security system installed, the security system can be installed in a minimum of time by merely the insertion of switch elements 26 within housings 24 by the removal of caps 28 and the insertion of prongs 48 within receiving sockets 36 accurately guided by ribs 60 fitting in grooves 38. Caps 28 are then pressed into housings 24 with annular projections 70 being received within annular grooves 40. By having caps 28 of various preselected colors, only a stock of various colored caps 28 need to maintained as the remaining components of switch assembly 20 may be of any single desired color. In the event of malfunctioning of element 26, it may be easily replaced in a minimum of time without the necessity of any splicing of wires or the like.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A magnetic switch assembly for a security system adapted to be inserted within a generally cylindrical opening in a fixed wooden framing member adjacent a movable closure member; said switch assembly comprising:

a generally cylindrical outer housing having a closed end and an opposed open end and adapted to fit in said cylindrical opening, said closed end having a pair of electrical leads extending therethrough;

a generally cylindrical magnetic switch element removably received within said housing and having a magnetic switch housed therein, a pair of electrical leads extending from said magnetic switch and removably connected to said electrical leads extending through said outer housing; and a circular end cap removably connected over the open end of said outer housing for covering said open end, said end cap being removed from said outer housing to permit selected insertion and removal of said magnetic switch element from said outer housing.

2. A magnetic switch assembly as set forth in claim 1 wherein said outer housing and said magnetic switch element have interfitting prong and socket combinations for removably connecting said switch element and associated electrical leads to said outer housing and electrical leads therethrough.

3. A magnetic switch assembly as set forth in claim 1 wherein said circular end cap has an outer planar surface forming a smooth continuation of the adjacent wooden framing member and completely covering the outer housing to prevent visible exposure of the outer housing.

4. In a home security system to actuate a signal upon the opening of movable closure member mounted within adjacent fixed wooden framing members comprising:

a generally cylindrical non-metallic housing having a closed end and an opposed open end and adapted to fit within a generally cylindrical opening in an associated wooden framing member, said closed end having at least one opening to receive a pair of electrical leads;

a magnetic switch element within said housing connected to said pair of electrical leads;

a circular end cap removably connected over the open end of said housing for covering said open end, said end cap having a peselected color similar to the color of the associated wooden framing member and having an outer surface generally flush with the adjacent surface of the wooden frame member and forming a smooth continuation thereof, said end cap being selectively removable from said housing for insertion of another end cap of a different preselected color; and a disc magnet mounted on said closure member adjacent said fixed wooden framing member adapted to be positioned in opposed relation to said end cap in a closed position of the wooden closure member.

5. In a home security system to actuate a signal upon the opening of a movable wooden closure member mounted within an adjacent fixed wooden frame and including a series loop electrical circuit;

a magnet mounted within an opening in the wooden closure member;

a magnetic switch assembly in said electrical circuit mounted within an opening in said fixed wooden frame and in axial alignment with said magnet in a closed position of the wooden closure member, said magnetic switch assembly including an outer housing having an open outer end and an opposed inner end having a pair of electrical leads extending therethrough, a magnetic switch element removably mounted within said outer housing and having a pair of electrical leads extending from an inner end thereof, disconnectable means electrically connecting said electrical leads on said magnetic switch element to permit easy removal of said switch element from said housing; and a removable end cap removably connected to said outer housing over the open end of said housing and completely covering said outer housing, the outer surface of said cap forming a smooth continuation of the adjacent surface of said wooden frame.

6. In a home security system as set forth in claim 5 wherein said end cap has a preselected color similar to the color of the adjacent wooden frame and is easily removed from said outer housing to permit replacement of said magnetic switch element.

7. In a home security system to actuate a signal upon the opening of a movable wooden closure member mounted within an adjacent fixed wooden frame and including a series loop electrical circuit;

a magnet mounted within an opening in the wooden closure member;

a magnetic switch assembly in said electrical circuit mounted within an opening in the fixed wooden frame and in axial alignment with said magnet in a closed position of the wooden closure member, said magnetic switch assembly including:

a generally cylindrical outer housing having a closed inner end and an opposed open outer end, said closed end having a pair of electrical leads connected thereto;

a generally cylindrical magnetic switch element removably mounted within said housing and having a magnetic switch therein, a pair of electrical leads extending from said magnetic switch, and interfitting prong and socket combinations between said switch element and said housing for electrically connecting the electrical leads of said magnetic switch to the electrical leads of said outer housing; and an end cap of a preselected color removably connected to said outer housing over the open end of said housing and completely covering said outer housing, the outer surface of said cap forming a smooth continuation of the adjacent surface of said wooden frame.

8. In a home security system as set forth in claim 7 wherein said magnetic switch is a reed switch having a pair of normally closed contacts when the closure member is in a closed position.

9. In a home security system as set forth in claim 7 wherein said cylindrical housing has a pair of opposed longitudinally extending internal grooves therein, and said switch element has an opposed pair of splines interfitting with said grooves for guiding the magnetic switch element into accurate position within said outer housing for accurate alignment of said interfitting prong and socket combinations between said outer housing and said magnetic switch element.

10. In a home security system as set forth in claim 7 wherein said switch element has an outer cylindrical body and a pair of opposed indentations are provided in the outer surface of said outer body to receive a suitable tool for removal of said switch element from said outer housing upon removal of said end cap thereby to permit replacement of said switch element.

11. A method of installing a security system within a building utilizing a plurality of magnetic switch assemblies mounted within bored openings in wooden framing members adjacent associated closure members of the building; said method comprising:

boring a generally cylindrical opening in a wooden framing member adjacent an associated closure member;

positioning an outer housing within the bored cylindrical opening, the outer housing having an open end and an opposed closed end with a pair of electrical leads connected to and extending from said opposed closed end;

positioning a removable switch element within the open end of said housing, said switch element having a pair of electrical leads extending therefrom being in electrical contact with said electrical leads of said housing upon positioning of said switch element within said housing; and placing a removable cap over the open end of said housing after positioning of said switch element within the housing, said cap covering the entire open end of said housing and preventing the housing from being explosed to view after positioning of said cap on said housing.

12. A method of installing a security system within a building utilizing a plurality of magnetic switch assemblies mounted within bored openings in wooden framing members of the building and a plurality of magnets mounted within associated closure members of the building with the magnetic switch assemblies being in axial alignment with the magnets in the closed position of said closure members; said method comprising:

boring a generally cylindrical opening in a closure member;

placing a magnet in said cylindrical opening;

boring a generally cylindrical opening in a fixed associated wooden framing member adjacent said closure member in axial alignment with said generally cylindrical opening in said closure member in the closed position of said closure member;

positioning an outer housing within said opening in said framing member, the outer housing having an outer open end and an opposed closed inner end with a pair of electrical leads connected to and extending from said opposed closed end;

positioning a generally cylindrical switch element having closed ends in accurate guided relation within the open end of said housing, the inner closed end of said cylindrical switch element having a pair of electrical leads extending therefrom and removably connected to said electrical leads of said housing upon accurate positioning of such cylindrical switch element within said housing; and placing a removable cap over the open end of said housing after positioning of said switch element within the housing to cover the open end thereof, said cap being removable from said housing to permit removal of said switch element therefrom and replacement thereof with another switch element.

* * * * *